US011325687B1

(12) United States Patent
Sharp

(10) Patent No.: US 11,325,687 B1
(45) Date of Patent: May 10, 2022

(54) MULTIPLE DUCT SYSTEM FOR CONVEYING EXHAUST GAS FROM OCEANGOING VESSELS TO A TREATMENT SYSTEM

(71) Applicant: Robert John Sharp, Camarillo, CA (US)

(72) Inventor: Robert John Sharp, Camarillo, CA (US)

( * ) Notice: Subject to any disclaimer, the term of this patent is extended or adjusted under 35 U.S.C. 154(b) by 0 days.

(21) Appl. No.: 17/324,105

(22) Filed: May 19, 2021

(51) Int. Cl.
*B63H 21/32* (2006.01)
*B08B 15/02* (2006.01)
*F01N 13/00* (2010.01)

(52) U.S. Cl.
CPC ..... *B63H 21/32* (2013.01); *B08B 15/02* (2013.01); *F01N 13/002* (2013.01); *F01N 13/004* (2013.01); *F01N 2590/02* (2013.01)

(58) Field of Classification Search
CPC ..... B63H 20/00; B63H 20/245; B63H 21/00; B63H 21/32; B08B 15/00; B08B 15/02; F01N 13/00; F01N 13/002; F01N 13/004; F01N 2590/02; F01N 3/00; F01N 3/10
USPC ..... 440/89 R
See application file for complete search history.

(56) References Cited

U.S. PATENT DOCUMENTS 8,402,746 B2 * 3/2013 Powell ..... B63H 21/32 440/89 R
9,291,083 B2 * 3/2016 Panziera ..... F01N 13/004
10,132,220 B2 * 11/2018 Tonsich ..... F01N 13/004

* cited by examiner

*Primary Examiner* — Lars A Olson

(57) ABSTRACT

A multi-circuit system for temporarily connecting to a plurality of exhaust pipes of an oceangoing vessel at berth or at anchor and treating captured exhaust gas. Each circuit includes an exhaust gas processing system, a duct system to reach from the processing system to an exhaust pipe; a duct inlet port for attachment to a connector receiving exhaust gas from an exhaust pipe. A positioning system supports the duct systems and connectors in a ganged relationship and positions the duct systems and connectors in a temporary operational position and in a non-operational position. In another embodiment, blower controller is responsive to a pressure measurement at the duct inlet port or the connector to control a blower speed to set or maintain the pressure to a desired pressure.

17 Claims, 7 Drawing Sheets

MULTIPLE DUCT SYSTEM FOR CONVEYING EXHAUST GAS FROM OCEANGOING VESSELS TO A TREATMENT SYSTEM

BACKGROUND

Emissions sources produce harmful air contaminants such as particulate matter (PM), oxides of nitrogen (NOx), volatile organic compounds (VOCs), and reactive organic gases (ROGs). The United States Environmental Protection Agency (EPA) and state and local agencies continue to tighten maximum emission limits. For example, the California Air Resources Board (CARB) has escalating regulations that require oceangoing vessels at berth to reduce emissions when at-berth. To meet increasingly stringent regulatory requirements, emissions control systems providers have emerged to reduce emissions from large emissions sources when they are most harmful. Emissions control systems capture and purify the exhaust from the emissions sources thereby preventing the release of emissions to the local environment.

Oceangoing vessels (OGV's) contain multiple emissions sources. OGV's such as containerships and auto carriers typically have a main engine, about four auxiliary diesel engines, an auxiliary boiler, and an incinerator. When an OGV is at-berth or at-anchor, the main engine does not operate. However, at least one auxiliary engine and one auxiliary boiler continue to operate to supply the vessel's electrical power and heating needs. A tanker OGV contains at least one large boiler to power the loading and offloading of liquid cargo in addition to at least one auxiliary engine to supply electrical power. Thus, there is a need for emissions control systems for OGV's to capture exhaust from a plurality of emissions sources within the OGV. However, prior emissions control systems, when operating on OGV's only service one or two emissions auxiliary engines, but not boilers.

Prior emissions control systems connect to individual exhaust pipes and combine the exhaust streams in a manifold, whereby the combined exhaust flow is then conveyed through a single duct to a treatment system, with the single duct supported by a crane.

A disadvantage of combining exhaust flows when connecting to both engines and boilers is that the backpressure of auxiliary engines is different than auxiliary boilers. There is a danger of back feeding the higher-pressure aux engine exhaust into the lower pressure boiler exhaust, causing inefficiencies or even failure of the boiler. As boiler-dependent tanker emissions from OGV's become regulated, the need to service both engines and boilers from the same vessel is necessary. However, combining the exhaust streams from engines and boilers into a manifold before conveying the combined gas through a single duct is not workable. Prior emissions control system providers have not been able to solve this previously unforeseen problem.

Another disadvantage of a commingled exhaust flow is that it is more difficult to regulate and monitor the emissions from oceangoing vessels. When the exhaust gas from two types of emissions sources are combined, the resulting composite emissions do not directly correlate with either source. Engine emissions have fundamentally different emissions characteristics than boiler emissions. Estimating emissions and exhaust flow rates for individual engines and boilers is straightforward by using a direct relationship to engine size and operating power. However, when the exhaust from engines and boilers is combined, the emissions characteristics cannot be predicted because of the nearly unlimited combinations engines, boilers, size, duty cycle, and operating power. Thus, the combination of emissions sources, especially the combination of engines and boilers, is a problem for regulators, and as a result, also prior emissions control systems.

Regulators verify or certify emissions control systems to assure that the emissions control system reduces a minimum level of emissions for a given emissions source. However, when the emissions source is indeterminate, such as when engine and boiler exhaust streams are comingled, then any verification or certification process is insufficient, because not every combination of engine and boiler can be tested. Unfortunately, prior emissions control systems combine exhaust streams, which presents a significant problem for regulators that desire to regulate oceangoing vessels that have both engine and boiler emissions.

Depending on the regulatory jurisdiction, geography, and date, OGV engines, boilers, or both may be regulated. When emissions from engines and boilers are combined, it is impossible to measure the effectiveness of the emissions control system for the regulated or unregulated fraction for each emissions source. If each individual engine or boiler cannot be measured directly, and if one is regulated while the other is not, then it is impossible to determine the effectiveness of the regulated and unregulated fractions. Furthermore, an emissions control system provider would otherwise be able to get credit for extra emissions reductions for emissions that are not regulated. Thus, prior emissions control systems that combine the exhaust flows of a plurality of emissions sources cannot be effectively regulated. Furthermore, prior emissions control system providers have not been motivated to reduce additional emissions sources because they cannot obtain revenue for indeterminate emissions reductions.

Furthermore, regulators desire to collect emissions data from a wide number of operating vessels to verify emissions estimates for their regular emissions inventories, which estimate emissions from all sources within a region. As of this writing, however, estimates of boiler emissions are vague and approximate, because only a few maritime boilers have been tested. Since prior emissions control system providers do not measure emissions while treating emissions, the data for boiler emissions remains inaccurate, which leads to inaccurate regulator emissions inventories.

Another disadvantage of combining more than one exhaust stream is the size of the single duct required to carry the combined flow. The large duct size can be dangerous during windy conditions when the wind comes from the direction that is not blocked by the oceangoing vessel. Prior emissions control systems have been required to shut down operations under these conditions, thereby increasing the emissions released to the atmosphere.

Yet another disadvantage of combining exhaust flows from a plurality of emissions sources in a manifold prior to conveying the single flow through a duct to a treatment system is that the operating dynamics of one of a plurality of emissions sources affects the combined flow. For example, oceangoing vessel boilers frequently operate by turning on when steam pressure falls below an operating threshold and turning off when steam pressure is above an operating threshold. This on/off control of boilers produces dynamics that affect the total flow rate and overall emissions concentration of the combined exhaust flow. Thus, even if an engine's emissions output may be mostly constant (which is easy to control efficiently), when combined with a cycling boiler emissions outlet, then the resulting process upset affects the controllability both the flow rate control and emissions reduction control, thereby reducing the efficiency of the emissions control for the entire combined stream, not just the boiler fraction. Thus, the efficiency of the emissions control of the engine's fraction suffers. A similar effect occurs when one of a plurality of auxiliary engines is turned on or off, which affects the controllability of the entire combined flow, not just the engine that is turned on or off. Thus, prior emissions control systems have been unnecessarily inefficient, which leads to more emissions released to the atmosphere, which causes harm to life and damage to natural and manmade assets.

Thus, there has been a long-felt need to increase the efficiency of emissions reductions from oceangoing vessels at berth or at anchor, as well as a long-felt need to treat boilers in addition to auxiliary engines on oceangoing vessels at berth or at anchor. These needs have not been addressed by the prior art.

BRIEF DESCRIPTION OF THE DRAWINGS

Features and advantages of the disclosure will readily be appreciated by persons skilled in the art from the following detailed description when read in conjunction with the drawing wherein.

DETAILED DESCRIPTION

Figure 1:
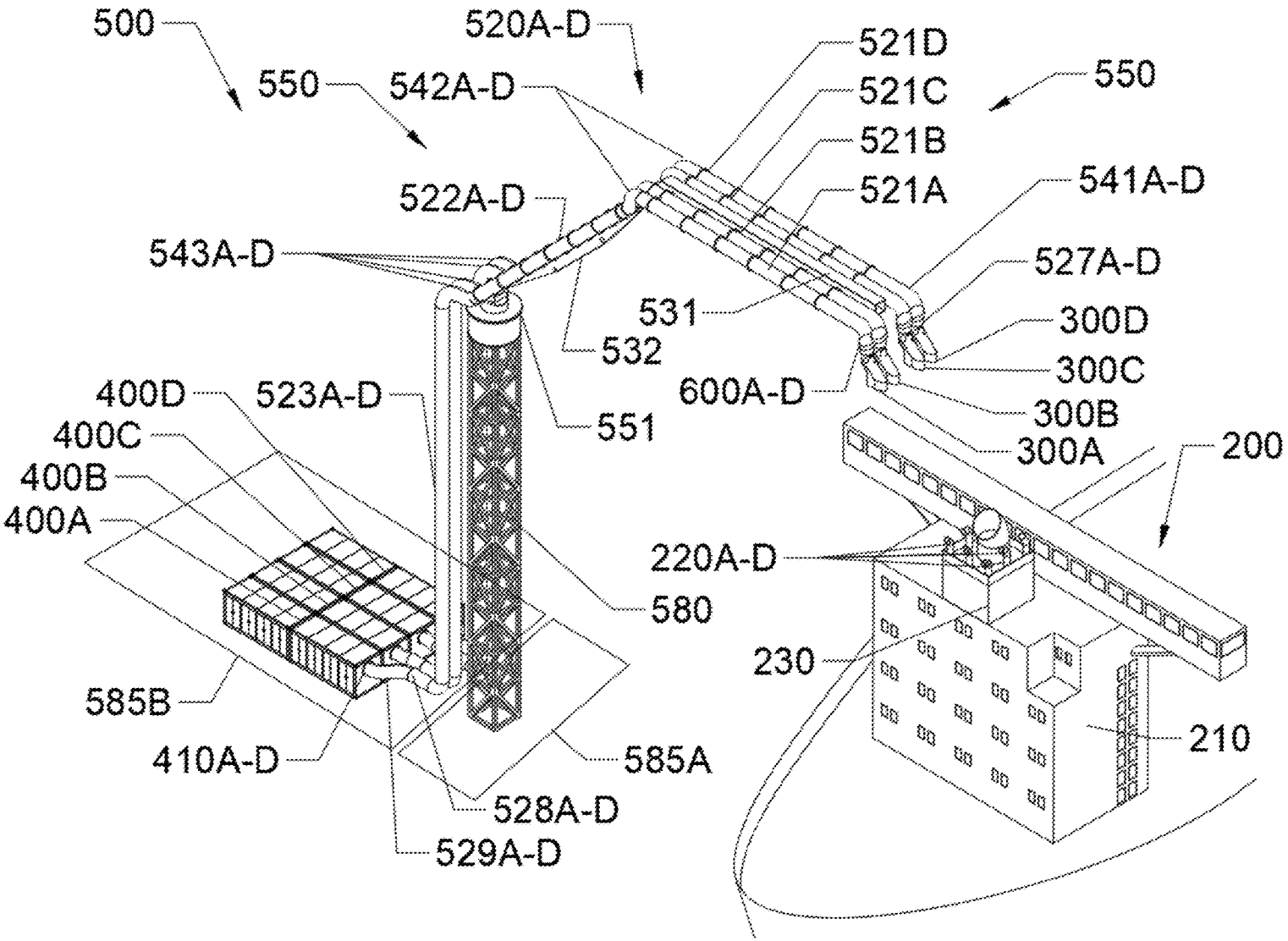
FIG. 1 shows a 4-circuit duct system for conveying exhaust gas from oceangoing vessels to a treatment system comprising a barge.

In the following detailed description and in the several figures of the drawing, like elements are identified with like reference numerals. The figures are not to scale, and relative feature sizes may be exaggerated for illustrative purposes.

The exemplary embodiment in FIG. 1 shows an emissions reduction as a service (ERaaS) system comprising a plurality of (four in this example) exhaust treatment circuits for temporarily connecting to an oceangoing vessel at berth. Oceangoing vessel 200 contains a plurality of exhaust pipes 220, of which four are operating and producing emissions in this example. Exhaust pipes 220 are located on top of funnel 230 which is located on or near superstructure 210. The corresponding emissions sources 215 from which exhaust pipes 220 are fluidically connected are located within the engine room of oceangoing vessel 200 but are not shown in FIG. 1.

FIG. 1 also shows a plurality of exhaust treatment circuits, each circuit comprising: a processing system 400A-400D for receiving exhaust gas at an inlet port 410A-D; a duct system 520A-D of a length selected to reach from processing system 400A-4000 to exhaust pipes 220A-D, the length ranging from approximately 100 feet to 2,000 feet depending on the application; an inlet port 527A-D on the duct system configured for attachment to connector 300A-D for receiving exhaust gas from an exhaust pipe 220A-D, with connector 300A-D is configured for collecting exhaust gas in an engaged position relative to exhaust pipe 220A-D; an outlet duct port 529A-D of the duct system configured for connection to inlet port 410A-410D of processing system 400A-400D; a positioning system 550 for supporting each of the duct systems 520A-D and connectors 300A-D in a ganged relationship and for positioning duct systems 520A-D and connectors 300A-D. Herein, "ganged relationship" means that a single unified positioning system supports and carries each of the duct systems 520A-D and connectors 300A-D together with one another as an assembly.

FIG. 1 also shows an exemplary embodiment of deployment platform 585A for supporting positioning system 550. Deployment platform 585A may be a concrete slab, a deck, a wharf, bare land, or other form of stationary land-based platform. Deployment platform 585A may also be a truck, a chassis, a trailer, or other land-based vehicle. Deployment platform 585A may also be a wharf, a jetty, a quay, a tension leg platform, or other stationary water-based platform. Deployment platform 585A may also be a barge, a vessel, a boat, or other water-based vehicle.

FIG. 1 also shows at least one deployment platform 585B for supporting at least one processing system 400A-4000. Deployment platform 585B may be a concrete slab, bare land, or other form of stationary land-based platform. Deployment platform 585B may also be a truck, a chassis, a trailer, or other land-based vehicle. Deployment platform 585B may also be a wharf, a jetty, a quay, a tension leg platform, or other stationary water-based platform. Deployment platform 585B may also be a barge, a vessel, a boat, or other water-based vehicle.

A single unified deployment platform 585 may support both at least one positioning system 550 and at least one processing system 400A-400D. Furthermore, one deployment platform may support a second deployment platform. In the exemplary embodiment shown, 585A and 585B may be separated by a distance between zero feet to 2,000 feet or more via connecting duct 528A-D. Connecting duct 528A-D may be located underground for part of its length and is preferred to be insulated. Connection duct 528A-D may also be at least partially floating or supported by a floating platform.

It may be desirable in an exemplary embodiment where there is limited space on the wharf next to the vessel due to cargo operations on the land-side of the oceangoing vessel to provide a land-based deployment platform 585A for the multiple duct exhaust capture system 500 and a water-based deployment platform 585B for at least one processing system 400A-400D, thereby removing any processing system 400A-4000 from the dock, thereby eliminating interference to dock operations due to any processing system 400A-4000. It may also be desirable in some applications to remotely locate deployment platform 585B, thereby locating any processing system 400A-400D mounted thereto away from dock operations.

Alternatively, also anticipated is an exemplary embodiment where there is limited space in a narrow channel where an oceangoing vessel is at-berth for other vessels to pass by and there is no space on the wharf on the land-side of the oceangoing vessel due to cargo loading and unloading. In this case, deployment platform 585A may be located on a watercraft with a minimal space requirement on the water side of the service oceangoing vessel and separate deployment platform 585B may be located either in another watercraft out of the way of the navigable aspect of the channel connected by connecting duct 528A-D. Alternatively, the separate deployment platform 585B may be located on the land although away from cargo loading and unloading operations.

In an operational mode, positioning system 550 is manipulated so that duct systems 520A-D and connectors 300A-D are in a temporary operational position in which connectors 300A-D are engaged to capture exhaust gases from respective exhaust pipes 220A-D and the plurality of duct systems 520A-D convey the collected exhaust gases to the respective processing systems 400A-D for treatment. In a non-operational mode, as shown in FIG. 1, positioning system 550 positions duct systems 520A-D and connectors 300A-D in a non-operational position in which duct systems 520A-D and connectors 300A-D are disengaged from the respective exhaust pipes 220A-D and the duct systems 520A-D and connectors 300A-D are moved away from exhaust pipes 220A-D.

Also, in the exemplary embodiment shown in FIG. 1, emissions duct system 520A-D is sized for the exhaust flow expected, with each duct system 520A-D having a cross-sectional area equivalent to a 12-inch diameter to 36-inch diameter, for example. Exhaust pipe connector 300A-D is configured to fit over an exhaust pipe 220A-D. Exhaust pipe connector 300A-D is fluidically connected to emissions duct system 520A-D. Emissions duct system 520A-D comprises duct inlet port 527A-D, flexible duct section 541A-D, duct section 521A-D, flexible duct section 542A-D, rigid duct section 522A-D, flexible duct section 543, rigid duct section 523A-D, connecting duct 528A-D, and duct outlet port 529A-D. Exhaust pipe connector 300A-D is fluidically connected to duct inlet port 527A-D, which is fluidically connected to flexible duct section 541A-D, which is fluidically connected to rigid duct section 521A-D, which is fluidically connected to flexible duct section 542A-D, which is fluidically connected to rigid duct section 522A-D, which is fluidically connected to flexible duct section 543A-D, which is fluidically connected to rigid duct section 523A-D, which is fluidically connected to connecting duct 528A-D, which is fluidically connected to duct outlet port 529A-D.

FIG. 1 shows all four exemplary emissions ducts 520A-D supported by a single exemplary positioning system 550. Positioning system 550, in this example, comprises positioner base 580 with a preferred height between 1 inch and 150 feet, pivoting base 551 mounted on top of positioner base 580 for an example horizontal pivotal movement between −180 degrees to 180 degrees. Positioning system 550 further comprises articulating boom segments 531 and 532 with a preferred approximate combined reach selected between 75 feet to 300 feet when connecting to containerships, auto carriers, or tankers in the Panamax class or larger size category. Smaller ERaaS applications would have a correspondingly reduced overall reach. Note that the designed combined reach of articulating boom segments 531 and 532 may be reduced if the configured preferred height of positioner base 580 is increased by a corresponding amount for a preferred example combined reach is between 75 feet and 300 feet. FIG. 1 shows two articulating crane segments as an example, although one to five or more crane segments may be implemented depending on the requirement. Note that any plurality between two and eight or more ducts such as 520A-D may be supported in ganged relation by a single positioning system 550.

An exemplary connection operation of the exemplary positioning system 550 depicted in FIG. 1 comprises rotating pivoting base 551 and articulating boom segments 531 and 532 from a stowed position to at least one extended configuration so that connectors 300A-D are coarsely positioned to be connectable to exhaust pipes 210A-D within the extendible range of flexible duct section 541A-D so that one or more people positioned near exhaust pipes 210A-D may manually install each connector 520A-D on a respective exhaust pipe 210A-D.

An exemplary disconnection operation of the exemplary positioning system 550 depicted in FIG. 1 comprises one or more people near exhaust pipes 210A-D may manually remove each connector 520A-D from each respective exhaust pipe 210A-D. Once all the connectors are removed, then articulating boom segments and pivoting base 551 are returned to at least one stowed position.

An alternative embodiment of FIG. 1 further comprises an optional connector positioner 600 for fine positioning of each connector 300A-D after a coarse positioning of pivoting base 551 and articulating boom segments 531 and 532. Each positioner 600 is remotely controllable and provides at least three degrees of freedom movement for fine horizontal positioning (left/right and forward/backward) and fine vertical positioning of each connector 300A-D. Optional positioner 600 provides fine positioning, for example, between 3 feet and 20 feet in each axis of movement. Thus, optional positioner 600 provides the option for remotely installing each connector without the need for manipulation by a person near exhaust pipe 220A-D during a connection or disconnection operation.

In an exemplary embodiment, connector 300A-D comprises a partial inverted cone configuration (not shown in FIG. 1) which can either rest atop a "straight-up" exhaust pipe 220 or can be manually manipulated over a curved (non-straight-up) exhaust pipe 220A-D so that both connector 300A-D, duct inlet port 527A-D, and a fraction of duct 541A-D overlap exhaust pipe 220A-D. Alternatively, connector 300A-D comprises a two-chamber rigid hood (shown in FIG. 1) that rests atop of anticipated shapes of exhaust pipe 220A-D, including straight-up, curved-over, and angled-over. In this exemplary embodiment, two-chamber connector 300A-D may be manually installed on exhaust pipe 220A-D or remotely installed if an optional connector positioning system 600 is installed.

In yet another exemplary embodiment, for connection to a large exhaust pipe 220A-D, two or more duct systems may share a single connector 300A-D.

Figure 2:
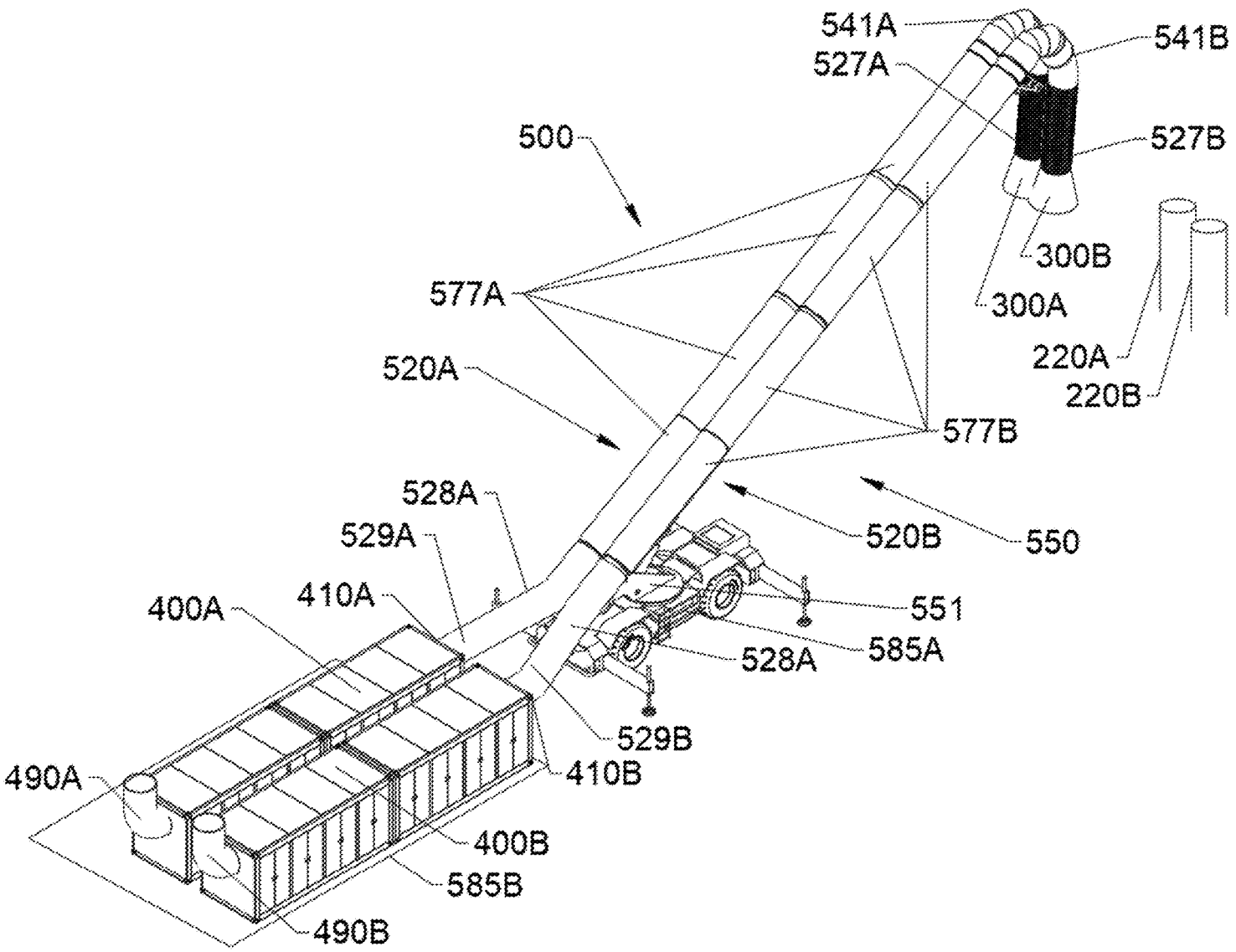
FIG. 2 shows an exemplary embodiment of a two-circuit duct exhaust capture system comprising a telescoping positioning system.

The exemplary embodiment in FIG. 2 shows an emissions reduction as a service (ERaaS) system comprising a plurality of (two in this example) exhaust treatment circuits for temporarily connecting to a smaller oceangoing vessel at berth such as a bulk ship or a general cargo ship, or to a land-based backup genset.

FIG. 2 also shows a plurality of exhaust treatment circuits (in this exemplary embodiment two circuits), each circuit comprising: a processing system 400A-400B for receiving exhaust gas at an inlet port 410A-400B; a duct system 520A-B of a length selected to reach from processing system 400A-400B to exhaust pipes 220A-B, the length, in this example, ranging from approximately 25 feet to 250 feet depending on the application; an inlet port 527A-527B on the duct system configured for attachment to connector 300A-300B for receiving exhaust gas from an exhaust pipe 220A-220B, with connector 300A-300B configured for collecting exhaust gas in an engaged position relative to exhaust pipe 220A-220B; an outlet duct port 529A-529B of the duct system configured for connection to inlet port 410A-410B of processing system 400A-400B; a telescoping version of positioning system 550 for supporting each of the duct systems 520A-520B and connectors 300A-300B in a ganged relationship and for positioning duct systems 520A-520B and connectors 300A-300B.

FIG. 2 also shows an exemplary embodiment of deployment platform 585A for supporting positioning system 550. Deployment platform 585A may be a driving crane (as shown in FIG. 2), a truck, a chassis, a trailer, an automated vehicle, or other land-based vehicle. Deployment platform 585A may alternatively be a concrete slab, a deck, a wharf, bare land, or other form of stationary land-based platform. Deployment platform 585A may alternatively be a wharf, a jetty, a quay, a tension leg platform, or other stationary water-based platform. Deployment platform 585A may alternatively be a barge, a vessel, a boat, or other water-based vehicle.

FIG. 2 also shows at least one deployment platform 585B for supporting at least one processing system 400A-400B. Deployment platform 585B may be a concrete slab (as shown in FIG. 2), bare land, or other form of stationary land-based platform. Deployment platform 585B may alternatively be a truck, a chassis, a trailer, an automated vehicle, or other land-based vehicle. Deployment platform 585B may alternatively be a wharf, a jetty, a quay, a tension leg platform, or other stationary water-based platform. Deployment platform 585B may alternatively be a barge or other water-based vehicle.

A single unified deployment platform (not shown) may support both at least one positioning system 550 and at least one processing system 400A-400B. Furthermore, a deployment platform may support another deployment platform. In the exemplary embodiment shown, 585A and 585B may be separated by a distance between zero feet to 2,000 feet or more via connecting duct 528A-528B. Connecting duct 528A-528B may be located underground for part of its length and is preferred to be insulated. Connection duct 528A-528B may also be at least partially floating or supported by a floating platform.

In an operational mode, positioning system 550 is manipulated so that duct systems 520A-520B and connectors 300A-300B are in a temporary operational position in which connectors 300A-300B are engaged to capture exhaust gases from respective exhaust pipes 220A-200B and the plurality of duct systems 520A-520B convey the collected exhaust gases to the respective processing systems 400A-400B for treatment. In a non-operational mode, as shown in FIG. 2, positioning system 550 positions duct systems 520A-520B and connectors 300A-300B in a non-operational position in which duct systems 520A-520B and connectors 300A-300B in which connectors 300A-300B are disengaged from the respective exhaust pipes 220A-220B and the duct systems 520A-520B and connectors 300A-300B are moved away from exhaust pipes 220A-220B.

In the exemplary embodiment shown in FIG. 2, each emissions duct system 520A-520B is respectively sized for the exhaust flow expected for the particular exhaust gas source associated with the corresponding exhaust pipe, with each emissions duct system 520A-520B having a cross-sectional area equivalent to a 12-inch diameter to 36-inch diameter, for example. Exhaust pipe connector 300A-300B is configured to fit over an exhaust pipe 220A-220B. Exhaust pipe connector 300A-300B is fluidically connected to emissions duct system 520A-520B. Emissions duct system 520A-520B comprises duct inlet port 527A-527B, telescoping rigid duct sections 577A-577B, connecting duct 528A-528B, and duct outlet port 529A-529B. Exhaust pipe connector 300A-300B is fluidically connected to duct inlet port 527A-527B, which is fluidically connected to flexible duct section 541A-541B, which is fluidically connected to telescoping rigid duct sections 577A-577B, which is fluidically connected to connecting duct 528A-528B, which is fluidically connected to duct outlet port 529A-529B, which is fluidically connected to inlet port 410A-410B of processing system 400A-410B.

In an exemplary embodiment, connector 300A-300B comprises a partial inverted cone configuration (shown in FIG. 2) which can either rest atop a "straight-up" exhaust pipe 220A-220B or can be manually manipulated over a curved (non-straight-up) exhaust pipe 220A-220B so that both connector 300A-300B, duct inlet port 527A-527B, and a fraction of duct 541A-541B overlap exhaust pipe 220. Alternatively, connector 300A-300B comprises a two-chamber rigid hood (not shown in FIG. 2) that rests atop of anticipated shapes of exhaust pipe 220A-220B, including straight-up, curved-over, and angled-over. In this exemplary embodiment, two-chamber connector 300A-300B may be manually installed on exhaust pipe 220A-220B or remotely installed if an optional connector positioning system 600 is installed.

Processing system 400A-400B may be a single road-transportable container (e.g., a 40-foot to 53-foot container) or two road-transportable containers (e.g., two 20-foot containers) in series. Processing system 400A-400B may be fixed or mounted on at least one road-transportable chassis for transportation of the ERaaS system from one location to another. Once the exhaust gas is processed by processing system 400A-400B, the purified gas exits outlet port 490A-490B.

Figure 3:
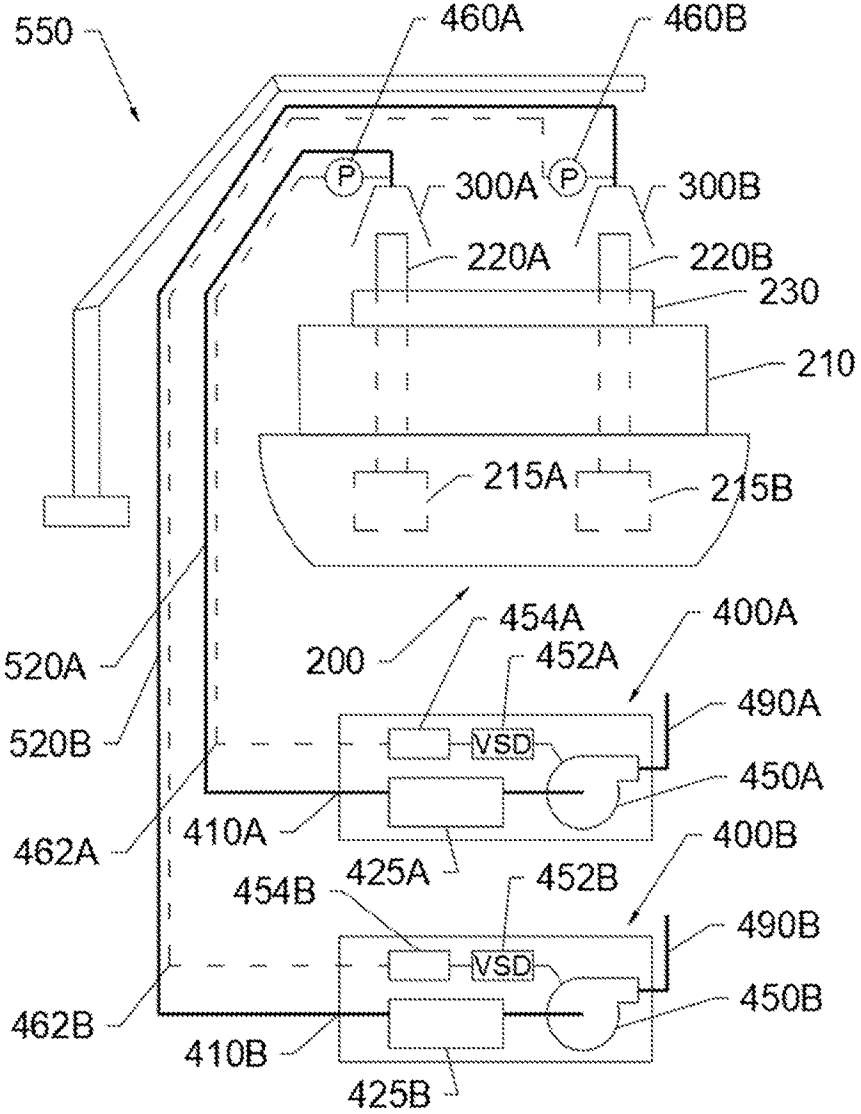
FIG. 3 is a diagram showing an exemplary 2-circuit duct exhaust capture system with individual control of the backpressure for each circuit.

FIG. 3 shows a block diagram of an exemplary emissions reduction as a service (ERaaS) system comprising a multiple duct exhaust capture system 500 comprising a plurality of (two in this example) exhaust treatment circuits, although any plurality of circuits may be represented in the same way. FIG. 3 further shows at least two emissions sources 215A-215B, each emissions source 215A-215B is fluidically connected to corresponding exhaust pipe 220A-220B. Ocean-going vessel 200 further comprises ducting connecting each emission source 215A-215B to exhaust pipe 220A-220B within superstructure 210 and funnel 230.

FIG. 3 further shows exemplary emissions ducts 520A-520B supported by a positioning system 550 in one of many deployed configurations. Each circuit comprises a connector 300A-300B, emissions duct system 520A-520B, and treatment system 400A-400B. In an operational mode (shown in FIG. 3), connector 300A-300B is engaged with exhaust pipe 220A-220B. Connector 300A-300B is fluidically connected to emissions duct system 520A-520B, which is fluidically connected to treatment system inlet port 410A-410B. Within treatment system 400A-400B, inlet port 410A-410B is fluidically connected to at least one purification unit 425A-425B, which is fluidically connected to blower 450A-450B, which is fluidically connected to outlet port 490A-490B. Each circuit further comprises pressure measurement sensor 460A-460B for sensing a pressure at the inlet of emission duct system 520A-520B or within connector 300A-300B, pressure measurement signal 462A-462B for transmitting the pressure measurement at the inlet of emission duct system 520A-520B or alternatively a pressure measurement within connector 300A-300B. Each pressure measurement sensor 460A-460B is selected for pressure in the approximate range of +/−ten inches of water absolute (gauge pressure), for example, corresponding to a control setpoint (SP) of approximately zero inches of water absolute. Pressure measurement 462A-562B is received by blower speed controller 454A-454B as a process variable (PV). In an exemplary embodiment, the output (CV) of blower speed controller 454A-454B is an input to a blower speed control, such as a variable speed driver (VSD) 452A-452B for controlling the speed of a blower 450A-450B. Pressure controller 454A-454B may be a proportional-integral-derivative (PID) controller or similar for independently controlling the pressure at the outlet of exhaust pipe 220A-220B. Unlike the prior art, the exhaust streams from the exhaust pipes 220A-220B are not combined, thereby allowing the pressure at each exhaust pipe 220A-220B to be controlled independently.

Operation of the exemplary embodiment in FIG. 3 comprises the following. During a pre-operational mode, controllers 454A-454B may be set in a manual mode for an optional warming up of treatment systems 400A-400B. After the optional warmup mode, controller 454A to a setpoint (SP) of approximately zero inches of water absolute and setting controller 454B to another setpoint (SP) of approximately zero inches of water absolute. Controller 454A-454B may optionally both set to identical setpoints, although both circuits are independently controlled. Prior to connecting to each exhaust pipe, controllers 452A-452B may be placed in an automatic mode whereby controllers 454A-454B will control blower speed controls 452A-452B to independently control the speeds of blowers 450A-450B with the goal of matching each pressure measurement 462A-462B to each controller setpoint. Alternatively, prior to connecting to each exhaust pipe, controllers 452A-452B may be placed in a manual mode whereby each controller 454A-454B is set to an estimated fan speed that is anticipated to capture selected approximate fraction of exhaust gas. In either case, after connection to each exhaust pipe, controllers 454A-454B are placed in an automatic mode during an operational mode. During the operational mode, each controller 454A-454B responds independently to each exhaust flow load to control each pressure to approximately zero inches of water absolute. For example, if a boiler is connected in one circuit, and an engine is connected to another circuit, any disturbance in the operation of either the engine or boiler will not affect the other circuit, thereby preventing impact to the operation of the more-sensitive boiler or preventing pressure dynamics that reduce the capture efficiency, for example.

Figure 4:
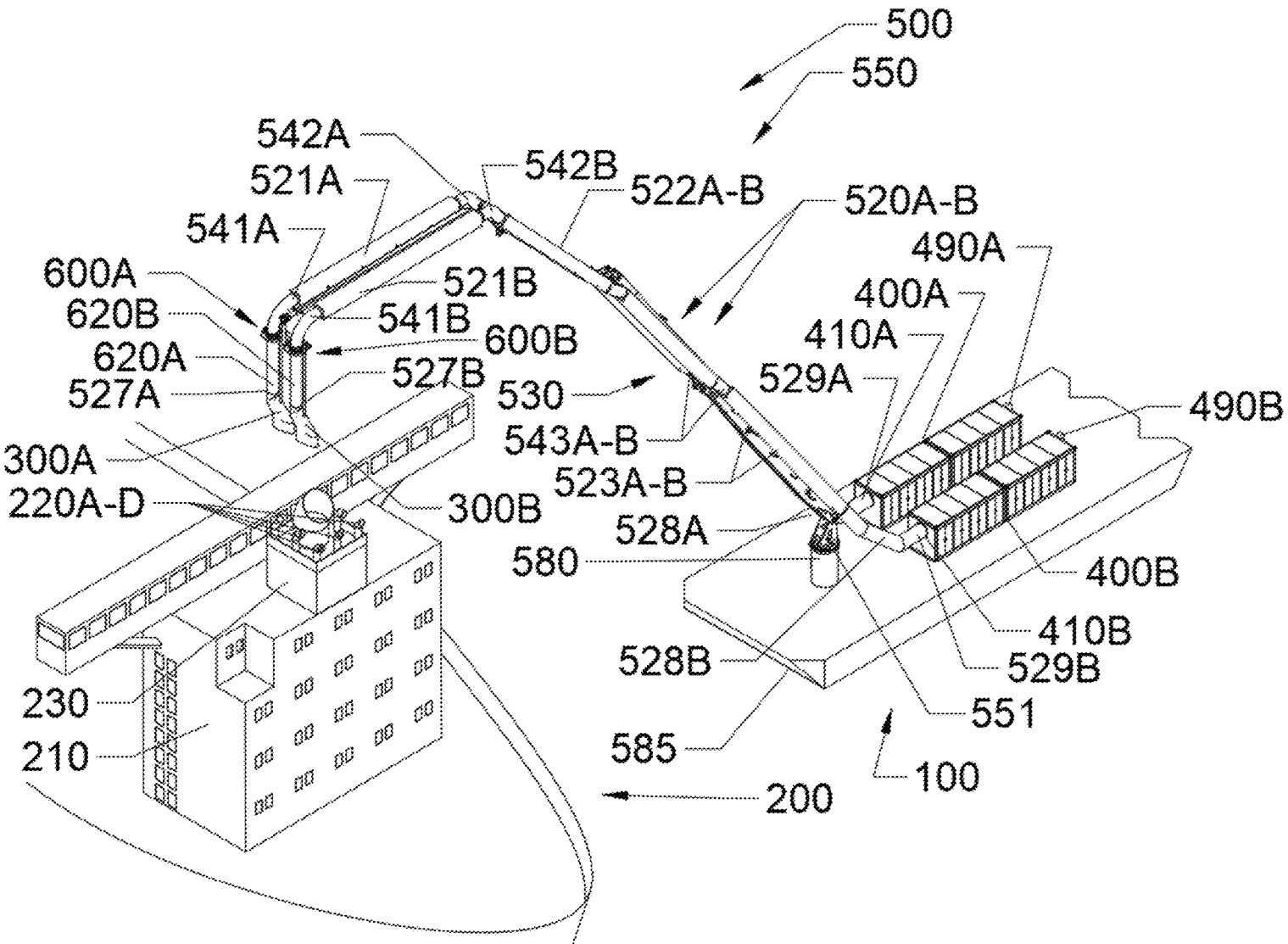
FIG. 4 is an exemplary embodiment of a 2-circuit duct system for conveying exhaust gas from oceangoing vessels to a treatment system a deployment platform comprising a barge and positioning system comprising a Z-folding boom.

The exemplary embodiment in FIG. 4 shows an emissions reduction as a service (ERaaS) system comprising a plurality of (two in this example) exhaust treatment circuits for temporarily connecting to an oceangoing vessel at berth. Oceangoing vessel 200 contains a plurality of exhaust pipes 220A-D, of which two are operating and producing emissions in this example. Exhaust pipes 220A-D are located on top of funnel 230 which is located near or on superstructure 210. The corresponding emissions sources from which exhaust pipes 220A-D are fluidically connected are located within the engine room of oceangoing vessel 200 but are not shown in FIG. 4.

The exemplary embodiment of a STAXcraft 100 emissions control watercraft depicted in FIG. 4 shows articulating positioning system 550 comprising a Z-folding boom having four articulatable sections, although more or less could be selected. Positioning system 550 may be configured for a fully folded configuration for storage and transport, and in at least one deployed configuration in which the sections are unfolded. Positioning system 550 includes a terminal boom section which supports the upstream rigid duct sections and a base boom section that supports the downstream rigid duct sections. See FIG. 5 and FIG. 6 for additional views and detail of an exemplary Z-folding system.

FIG. 4 also shows two exhaust treatment circuits, each circuit comprising: a processing system 400A-400B for receiving exhaust gas at an inlet port 410A-410B; a duct system 520A-B of a length selected to reach from processing system 400A-400B to exhaust pipes 220A-D, the length ranging from approximately 100 feet to 350 feet depending for a barge-based example embodiment on the application; an inlet port 527A-527B on the duct system configured for attachment to connector 300A-300B for receiving exhaust gas from an exhaust pipe 220A-D, with connector 300A-300B is configured for collecting exhaust gas in an engaged position relative to exhaust pipe 220A-D; an outlet duct port 529A-529B of the duct system configured for connection to inlet port 410A-410B of processing system 400A-400B; a positioning system 550 for supporting each of the duct systems 520A-B and connectors 300A-300B in a ganged relationship and for positioning duct systems 520A-B and connectors 300A-300B.

FIG. 4 also shows an exemplary embodiment of deployment platform 585 for supporting positioning system 550 and at least one processing system 400A-400B. Deployment platform 585 may be a barge (as shown in FIG. 4), a vessel, a boat, or other water-based vehicle. Deployment platform 585 may also be a concrete slab, a deck, a wharf, bare land, or other form of stationary land-based platform. Deployment platform 585 may also be a driving crane, a truck, a chassis, a trailer, an automated vehicle, or other land-based vehicle. Deployment platform 585 may also be a wharf, a jetty, a quay, a tension leg platform, or other stationary water-based platform.

A single unified deployment platform 585 may support both at least one positioning system 550 and at least one processing system 400A-400B. Furthermore, a deployment platform 585 may support another deployment platform 585. In an alternative exemplary embodiment, two deployment platforms may be separated by a distance between zero feet to 2,000 feet or more via connecting duct 528A-528B, with each deployment platform being either land-based or water-based. Connecting duct 528A-528B may be located underground for part of its length and is preferred to be insulated. Connection duct 528A-528B may also be at least partially floating or supported by a floating platform.

In an operational mode, positioning system 550 is manipulated so that duct systems 520A-B and connectors 300A-300B are in a temporary operational position in which connectors 300A-300B are engaged to capture exhaust gases from respective exhaust pipes 220A-D and the plurality of duct systems 520A-D convey the collected exhaust gases to the respective processing systems 400A-400B for treatment. In a non-operational mode, as shown in FIG. 4, positioning system 550 positions duct systems 520A-B and connectors 300A-300B in a non-operational position in which duct systems 520A-B and connectors 300A-300B in which connectors 300A-300B are disengaged from the respective exhaust pipes 220A-D and the duct systems 520A-B and connectors 300A-300B are moved away from exhaust pipes 220A-D.

Also, in exemplary embodiment shown in FIG. 4, emissions duct system 520A-B is sized for the exhaust flow expected, with each duct system 520A-B having a cross-sectional area equivalent to a 12-inch diameter to 36-inch diameter, for example. Exhaust pipe connector 300A-300B is configured to fit over an exhaust pipe 220A-D. Exhaust pipe connector 300A-300B is fluidically connected to emissions duct system 520A-B. Emissions duct system 520A-B comprises duct inlet port 527A-527B, flexible duct section 541A-541B, rigid duct section 521A-521B, flexible duct section 542A-542B, rigid duct section 522A-522B, flexible duct section 543A-B, rigid duct section 523A-B, connecting duct 528A-528B, and duct outlet port 529A-529B. Exhaust pipe connector 300A-300B is fluidically connected to duct inlet port 527A-527B, which is fluidically connected to flexible duct section 541A-541B, which is fluidically connected to rigid duct section 521A-521B, which is fluidically connected to flexible duct section 542A-542B, which is fluidically connected to rigid duct section 522A-B, which is fluidically connected to flexible duct section 543A-B, which is fluidically connected to rigid duct section 523A-B, which is fluidically connected to connecting duct 528A-528B, which is fluidically connected to duct outlet port 529A-529B.

FIG. 4 shows both exemplary emissions ducts 520A-B supported by a single exemplary positioning system 550. Positioning system 550, in this example, comprises positioner base 580 with a preferred height between 3 feet and 150 feet. Positioning system 550 further comprises pivoting base 551 mounted on top of positioner base 580 for a preferred minimum pivotal movement between −180 degrees to 180 degrees. Positioning system 550 further comprises exemplary Z-folding boom 530 comprising two to five (for example) articulating boom segments (see FIG. 5) with a preferred combined approximate reach selected between 75 feet to 200 feet when connecting to containerships, auto carriers, or tankers in the Panamax class or larger size category. Smaller ERaaS applications would have a correspondingly reduced overall reach and likely reduced number of boom segments. Note that the selected reach of articulating crane 500 may be reduced if the selected height of positioner base 580 is increased by a corresponding amount. FIG. 4 shows four articulating boom/rigid duct sections as an example, although any number of segments may be implemented depending on the requirement. Note that any plurality of ducts 520A-B, preferably between two and four, or more, may be supported in a ganged relationship by a single positioning system 550.

In an exemplary connection operation of the exemplary positioning system 550 shown in FIG. 4 [5?] comprises rotating pivoting base 551 and articulating boom segments 531, 532, 533, and 534 from a stowed position to at least one extended configuration so that connectors 300A-300B are coarsely positioned to be connectable to exhaust pipes 210.

FIG. 4 further shows positioning system 550 further comprising an optional connector positioner 600A-600B for fine positioning of each connector 300A-300B after a coarse positioning of pivoting base 551 and articulating boom segments 531, 532, 533, and 534. Optional positioner 600A-600B comprises a rotatable duct flange and a flexible duct 620A-620B that is inserted between duct inlet port 527A-527B and flexible duct section 541A-541B. Each positioner 600A-600B is remotely controllable and provides at least three degrees of freedom movement for fine horizontal positioning (left/right and forward/backward) and fine vertical positioning of each connector 300A-300B. Optional positioner 600A-600B provides fine positioning, for example, between 3 feet and 20 feet in each axis of movement. Thus, optional positioner 600A-600B provides the option for remotely installing each connector without the need for manipulation by a person near exhaust pipe 220A-D during a connection or disconnection operation.

An exemplary disconnection operation of the exemplary positioning system 550 depicted in FIG. 4 comprises lifting each connector 300A-300B from its respective exhaust pipe 220A-D with optional positioner 600A-600B, articulating boom segments 531, 532, 533, and 534 and rotating pivoting base 551 from an operational position to at least one non-operational (stowed) position.

An alternative exemplary disconnection operation comprises one or more people near exhaust pipes 210A-D may manually remove each connector 300A-300B from each respective exhaust pipe 210A-D. Once all the connectors are removed, then articulating boom segments 531, 532, 533, and 534 and rotating pivoting base 551 from an operational position to at least one non-operational (stowed) position.

FIG. 4 also shows an exemplary embodiment, whereas connector 300A-300B comprises a two-chamber rigid hood configured to rest atop of anticipated shapes of exhaust pipe 220A-D, including straight-up, curved-over, and angled-over. Exemplary two-chamber connector 300A-300B may be manually installed on exhaust pipe 220A-D or remotely installed if an optional connector positioning system 600A-600B is installed. Alternatively, a partial inverted cone configuration (not shown in FIG. 4) which can either rest atop a "straight-up" exhaust pipe 220A-D or can be manually manipulated over a curved (non-straight-up) exhaust pipe 220A-D so that both connector 300A-300B, duct inlet port 527A-527B, and a fraction of duct 541A-541B overlap exhaust pipe 220A-D.

In yet another exemplary embodiment, for connection to a large exhaust pipe 220A-D, such as may be found on tankers, two or more duct systems may share a single connector 300A-300B.

Figure 5:
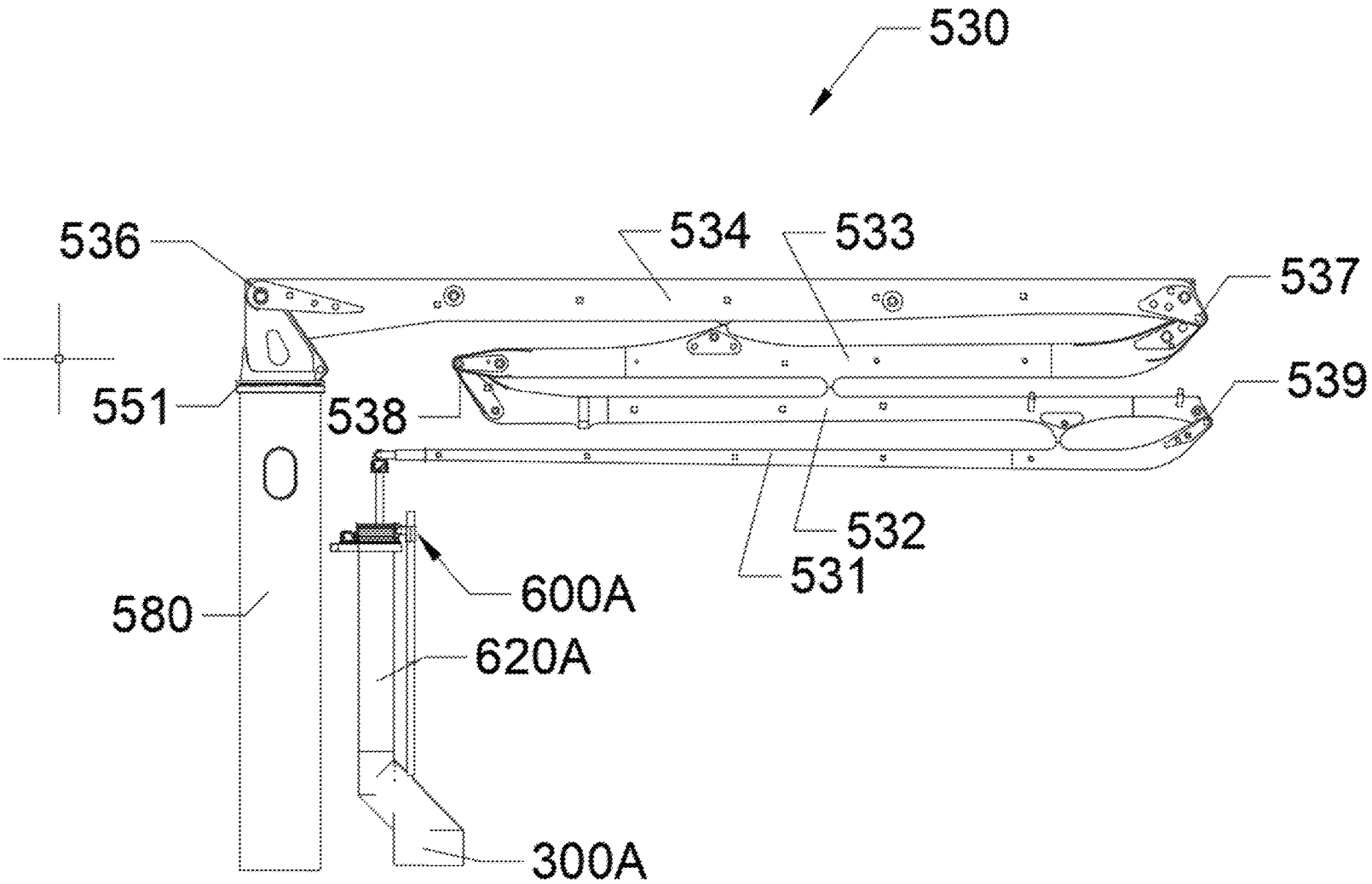
FIG. 5 is an exemplary embodiment of positioning system comprising a Z-folding boom. An optional connector positioning system is also shown.

FIG. 5 shows profile view of an exemplary Z-folding boom 530 for supporting a plurality of emissions duct systems 520A-520B (not shown in FIG. 5 to show the underlying structure). Z-folding boom 530 comprises a plurality of articulatable boom sections, each of the plurality of boom sections connected to an adjacent boom section by a respective hinge, the boom system configured for a fully folded (stowed) configuration (shown in FIG. 5) for storage and transport and in one or more deployed configurations in which the boom sections are unfolded about the respective hinges (see FIG. 4 for an example of an unfolded configuration).

In the exemplary embodiment shown in FIG. 5, positioner base 580 supports a pivoting base 551 mounted on top of positioner base 580 for a preferred minimum horizontal pivotal movement between −180 degrees to 180 degrees, although less rotational ability may be chosen in some embodiments. A base hinge 536 pivotally connects pivoting base 551 to a base boom section 534. Hinge 537 pivotally connects boom section 534 to boom section 533. Hinge 538 pivotally connects boom section 533 to boom section 532. Hinge 539 pivotally connects boom section 532 to terminal boom section 531. A different number of hinges and boom sections are selected for different embodiments.

FIG. 5 also shows exemplary optional connector positioning mechanism 600A, a connector extending duct 620A, and a connector 300A (only the near side shown).

Figure 6:
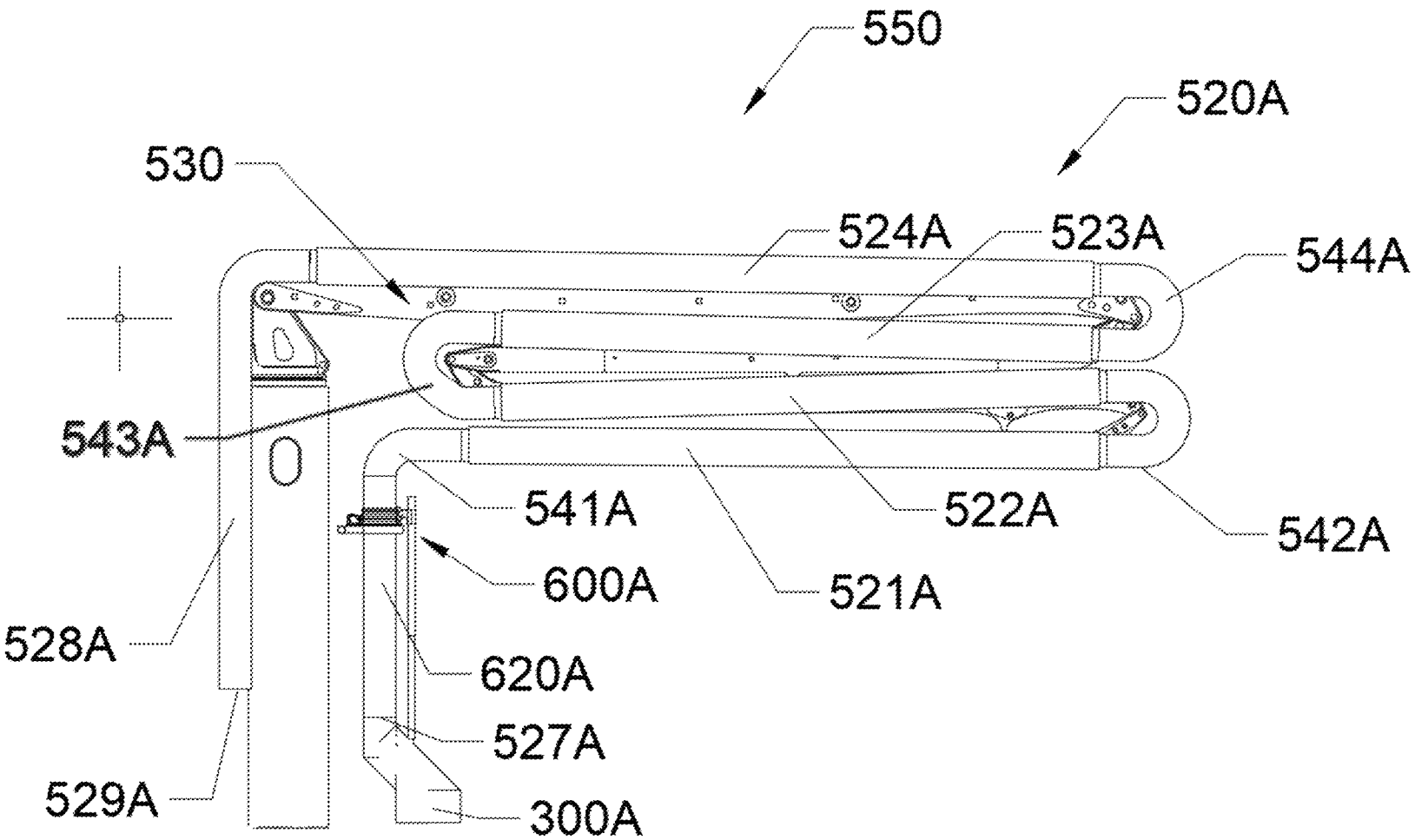
FIG. 6 is an exemplary embodiment of a multiple duct exhaust capture system comprising a Z-folding boom and an emissions duct system mounted thereto. An optional connector positioning system is also shown.

FIG. 6 shows profile view of an exemplary positioning system 550 comprising Z-folding boom 530 (See FIG. 5) for supporting a plurality of emissions duct systems, of which only 520A is shown, in a ganged relationship. FIG. 6 shows a fully folded (stowed) configuration. Each rigid duct section is connected to an adjacent rigid duct section by a flexible duct section. In this example, FIG. 6 only shows the near circuit, with the other circuit(s) similarly mounted. Note that FIG. 6 could also represent a two-circuit, or a four-circuit configuration, for example, or any plurality of circuits. In preferred embodiments, a corresponding number of emissions duct systems such as 520A are located on each side of positioning system 550 to balance the weight evenly. However, it is anticipated that a different number of emissions duct systems could be used if Z-folding boom 530 is configured to accept the weight imbalance or if non-functioning counterweights are used.

The downstream end of flexible duct section 541A is fluidically connected to rigid duct section 521A, which is fluidically connected to flexible duct section 542A, which is fluidically connected to rigid duct section 522, which is fluidically connected to flexible duct section 543A, which is fluidically connected to rigid duct section 523A, which is fluidically connected to flexible duct section 544A, which is fluidically connected to rigid duct section 524A, which is fluidically connected to connecting duct 528A, which terminates at duct outlet port 529A, which is the downstream (base) end of duct system 520A.

Referring to both FIG. 5 and FIG. 6, each boom section of Z-folding boom 530 is mounted thereto a corresponding rigid duct section of each of the plurality of plurality of duct systems, and wherein corresponding ones of the flexible duct sections are arranged at corresponding hinges of Z-folding boom 530. Thus, in this exemplary embodiment, each rigid duct section 521A is mounted to boom segment 531, each rigid duct section 522A is mounted to boom segment 532, each rigid duct section 523A is mounted to boom segment 533, and each rigid duct section 524A is mounted to boom segment 534. In alternative anticipated embodiments, the addition or subtraction of boom segments would have a corresponding number of rigid duct sections. Thus, each boom segment and ganged rigid duct section move as a unit as positioning system 550 is articulated between at least one stowed position and at least one operating configuration.

In an exemplary embodiment shown in FIG. 6, optional connector positioning mechanism 600A is inserted between connector 300A and duct system 520A, allowing connector 300A and optional connector extending duct 620A to be rotated a minimum of 270 degrees about an approximate vertical axis together. Optional connector extending duct 620A is considered part of (or an extension of) duct system 520A, which fluidically connects to connector 300A to the rest of duct system 520A. Optional connector extending duct 620A may be a flexible duct, for example, that is collapsible in length in a minimum ratio of 3 to 1 to allow connector 300A to be raised or lowered while maintaining a duct connection. Optional connector extending duct 620A may also comprise rigid or simi-rigid telescoping duct sections, for example. Optional connector positioning mechanism allows the connector 300A and optional connector extending duct 620A to rotate about an approximate vertical axis while also preventing a selected maximum of ambient air from entering the process flow through the interface the remainder of duct system 520A and optional extending duct 620A. The resulting system comprising optional connector positioning mechanism 600A, optional connector extending duct 620A, and connector 300A allows connector 300A to be aligned with an exhaust pipe 220A-D during the connecting procedure. For example, when connecting to an oceangoing vessel 200 from the port side, connector 300A would be oriented in the opposite direction compared to connecting from the starboard side. Optional connector positioning mechanism 600A allows connector 300A to be oriented remotely during the connection process, which eliminates the need to guess a pre-set orientation of connector 300A prior to extending capture system 500 from a stowed to an operating state, thereby preventing a iterative trial-and-error approach to find an workable orientation of connector 300A relative to exhaust pipe 220A-D.

In another contemplated embodiment that does not include an optional connector positioning mechanism 600A, then duct inlet port 520A is simply the upstream end of flexible duct section 541A (which is also the duct inlet port 527A in this example) which is fluidically connected to connector 300A. Thus, the most upstream end (the terminal end) of duct system 520A is duct inlet port 527A which is fluidically connected to connector 300A. This alternative embodiment (without optional connector positioning mechanism 600A) is best suited for exhaust pipes 220A-D that are vertically exiting or "straight up" that do not have an outlet bend requiring connector 300A to be oriented relative to exhaust pipe 220A-D. This alternative embodiment (without mechanism 600A) may also be used if there is easy access to exhaust pipes 220A-D so that connector 300A0 and a fraction of duct 541A may be manually installed over exhaust pipe 220A-D. Note that most oceangoing vessel exhaust pipes 220A-D have curved or angular configurations (not straight up) to direct the exhaust stream aft while the vessel is traveling. Land-based backup gensets, however, have mostly straight up exhaust pipes because they are not mobile.

Figure 7:
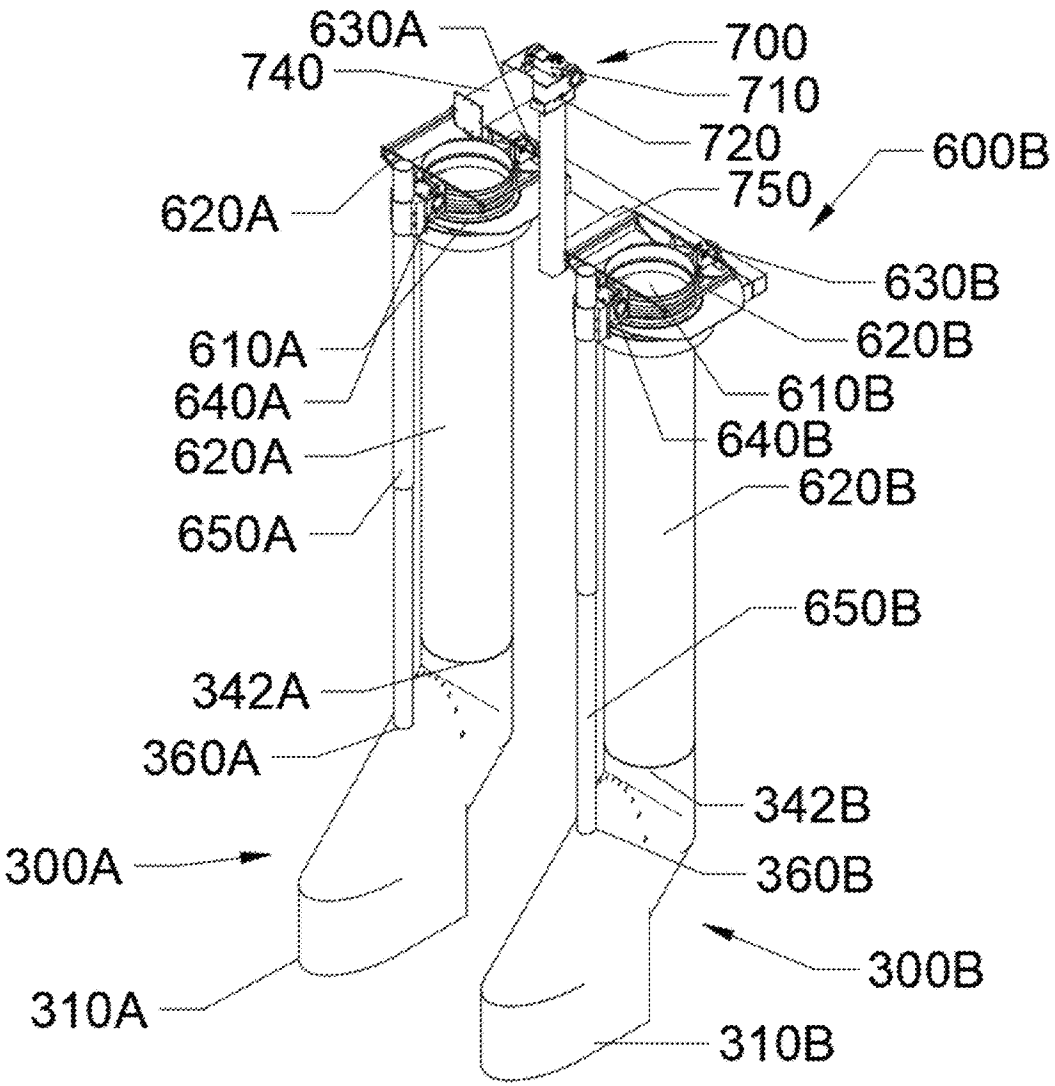
FIG. 7 is an exemplary embodiment of a connector positioning mechanism boom interface and (two in this example) connector positioning mechanisms.

FIG. 7 shows an exemplary embodiment of connector positioning system 600A-600B and tip interface 700. Two connector positioning systems 600A-600B are shown, although any plurality of connector positioning systems 600A-600B may be mounted on tip interface 700.

Tip interface 700 mounts to the terminal end of a terminal boom segment of a positioning system 550 and provides a frame for installing a selected number of connector positioning systems 600A-600B through optional pitch and roll dampers. Pitch and roll dampers are installed to limit the amount of torque and side force that may be transmitted from any attached connector positioning systems. Furthermore, if some aspect of tip interface 700 or any connector positioning system 600A-600B makes contact during a positioning operation with an external object (an oceangoing vessel for example), then the force transmitted to positioning system 550 is limited, thereby increasing safety. Furthermore, the optional dampers on tip interface 700 reduce oscillation at the tip of positioning system 550 during manipulation of the positioning system 500 or from a wind forcing function, for example.

Pitch damper 710 is a rotary hydraulic actuator in this example where the inlet and outlet of damper 710 are connected through an optional hydraulic resistance. Roll damper 720 is a rotary hydraulic actuator in this example where the inlet and outlet of damper 720 are fluidically connected though an optional hydraulic resistance. Optionally, a hydraulic circuit may be installed through valving so either damper 710 or damper 720 may be hydraulically actuated to urge a respective motion when positioning connector positioning systems 600A-600B.

Rotational duct flange mechanism 610 allows the assembly comprising connector 300A-300B and connector extending duct 620A-620B to rotate relative to the attached flexible duct 541A-541B.

In an installation or removal mode, actuator 630 is for urging connector 300A-300B left or right (the "X" axis) and actuator 640 is for urging connector 300A-300B forward or backward (the "Y" axis). In this exemplary embodiment, actuators 630 and 640 are driven by a hydraulic system (not shown). The hydraulic force may be configured to limit the force that may be applied to connector 300A-300B, thereby increasing safety when any part of the system impacts an external object.

In an operating mode, hydraulic valving connects the hydraulic inlets and outlets through a selected hydraulic resistance. Thus, in an operating mode, both actuator 630 and actuator 640 are allowed to freely move with a resistance proportional to the hydraulic resistance selected. Thus, for example, when an oceangoing vessel rolls back and forth, a connector 300A-300B may move with it.

Actuator 650 is for urging connector 300A-300B up or down (the "Z" axis). In an installation or removal mode, actuator 650 is for urging connector 300A-300B up or down is driven by a pneumatic piston, in this example. The pneumatic force may be configured to limit the force that may be applied to connector 300A-300B. In an operating mode, the pneumatic pressure is selected to apply a preselected downward force on connector 300A-300B, thereby urging connector 300A-300B to remain seated over exhaust pipe 220A-D. Furthermore, in an operating mode, connector 300A-300B is allowed to also freely move up and down in response to movements by exhaust pipe 220A-D.

In a removal mode, the pneumatic pressure is reduced, allowing a retract mechanism (not shown) to raise connector 300A-300B and pull it away from exhaust pipe 220A-D. Alternatively, or in conjunction with a retract mechanism, a vacuum may be applied to pneumatic actuator 650.

Actuator 650 is linked to connector 300 by a spherical pivot 360, which allows connector 300 to rotate to accommodate the mechanical connection to exhaust pipe 220.

Although the foregoing has been a description and illustration of specific embodiments of the subject matter, various modifications and changes thereto can be made by persons skilled in the art without departing from the scope and spirit of the invention.

GENERIC REFERENCE NUMERALS

100 STAXcraft (Emissions Control Watercraft)
200 Serviced Watercraft, Vessel, or Oceangoing Vessel (OGV)
210 Superstructure/House/Accommodation Block
215 Emissions Source
220 Emissions Source Exhaust Pipe
230 Funnel
300 Connector
310 Inlet/Inlet Skirt
342 Outlet
350 Outlet Duct
400 Processing System/Gas Treatment System
410 Inlet Port
425 Purification Unit
450 Blower/Fan
452 Blower Speed Control/Variable Speed Drive (VSD)
454 Blower Speed Controller/PID
460 Pressure Measurement Sensor
462 Pressure Measurement Signal
490 Outlet Port
500 Multiple Duct Exhaust Capture System
520 Emissions Duct System
521 Rigid Duct Section 1
522 Rigid Duct Section 2
523 Rigid Duct Section 3
524 Rigid Duct Section 4
525 Rigid Duct Section 5
527 Duct Inlet Port
528 Connecting Duct
529 Duct Outlet Port
530 Z-Folding Boom
531 Boom Segment 1
532 Boom Segment 2
533 Boom Segment 3
534 Boom Segment 4
535 Boom Segment 5
536 Hinge 1
537 Hinge 2
538 Hinge 3
539 Hinge 4
541 Flexible Duct Section 0
542 Flexible Duct Section 1-2
543 Flexible Duct Section 2-3
544 Flexible Duct Section 3-4
545 Flexible Duct Section 4-5
546 Flexible Duct Section 5-6
547 Flexible Duct Section 6-7
550 Positioning System
551 Pivoting Base
577 Telescoping Duct Section
580 Positioner Base
585 Deployment Platform
600 Connector Positioning Mechanism
610 Rotational Duct Flange Mechanism
620 Connector Extending Duct
630 "X" Actuator (Left/Right)
640 "Y" Actuator (Forward/Back)
650 "Z" Actuator (Up/Down)
700 Connector Positioning Mechanism Boom Interface
710 Pitch Damper
720 Roll Damper

What is claimed is:

1. A multi-circuit system for temporarily connecting to a plurality of exhaust pipes of an oceangoing vessel at berth or at anchor and treating captured exhaust gas, the system comprising:

a plurality of exhaust treatment circuits, each circuit including:

a processing system for receiving exhaust gas at an inlet port;

a duct system having a longitudinal extent sufficient to reach from the processing system to an exhaust pipe on the oceangoing vessel;

an inlet port of the duct system configured for attachment to a connector receiving exhaust gas from one of said plurality of exhaust pipes and the connector configured for capturing exhaust gas in an engaged position relative to the exhaust pipe; an outlet duct port of the duct system configured for connection to the inlet port of the processing system;

a single unified positioning system for supporting each of the duct systems and connectors in a ganged relationship, the positioning system configured to position said duct systems and connectors in a temporary operational position in which the connectors are engaged to capture exhaust gas from the respective exhaust pipes and the plurality of duct systems convey the captured exhaust gas to the respective processing systems for treatment, and to position said duct systems and connectors in a non-operational position in which the connectors are disengaged from the respective exhaust pipes and the duct systems and connectors are moved away from the vessel.

2. The system of claim 1, wherein the positioning system comprises a crane system mounted on a pivoting base, the pivoting base mounted on a deployment platform, the deployment platform selected from the set consisting of a land-based vehicle, a water-based vehicle, a truck, a barge, a semi-submersible platform, a tension leg platform a chassis, a trailer, a stationary platform on water, a quay, a wharf, a jetty, a stationary platform on land.

3. The system of claim 2, wherein the positioning system comprises: a Z-folding boom having a plurality of articulatable boom sections, each of the plurality of boom sections connected to an adjacent boom section by a respective hinge, the boom system configured for a folded configuration for storage or transport and in one or more deployed configurations in which the boom sections are unfolded about the respective hinges, the boom sections including a terminal boom section and a base boom section.

4. The system of claim 1, wherein each exhaust treatment circuit further comprises:

a connector positioning mechanism carried by the positioning system and configured to orient the corresponding connector over an exhaust pipe of the vessel to capture exhaust gas emitted from the exhaust pipe; and wherein the connector positioning mechanism includes a rotational positioning mechanism configured to rotate the connector to align the connector with the exhaust pipe.

5. The system of claim 1, wherein:

each circuit includes a blower connected fluidically to the duct system;

each circuit includes a pressure measurement sensor for measuring a gas pressure at the inlet of the duct system or within the connector and for transmitting a signal indicative of the sensed gas pressure;

each circuit includes a blower controller responsive to the signal for controlling a speed of the blower to control the gas pressure at said one of the plurality of exhaust pipes.

6. A multi-circuit system for temporarily connecting to a plurality of exhaust pipes of an oceangoing vessel at berth or at anchor and treating captured exhaust gas, the system comprising:

a plurality of exhaust treatment circuits, each circuit including:

a processing system for receiving exhaust gas at an inlet port;

a duct system having a longitudinal extent sufficient to reach from the processing system to an exhaust pipe on the oceangoing vessel;

an inlet port of the duct system configured for attachment to a connector receiving exhaust gas from one of said plurality of exhaust pipes and the connector configured for capturing exhaust gas in an engaged position relative to the exhaust pipe; an outlet duct port of the duct system configured for connection to the inlet port of the processing system;

a single unified positioning system for supporting each of the duct systems and connectors in a ganged relationship, the positioning system configured to position said duct systems and connectors in a temporary operational position in which the connectors are engaged to capture exhaust gas from the respective exhaust pipes and the plurality of duct systems convey the captured exhaust gas to the respective processing systems for treatment, and to position said duct systems and connectors in a non-operational position in which the connectors are disengaged from the respective exhaust pipes and the duct systems and connectors are moved away from the vessel;

each exhaust treatment circuit including a blower connected fluidically to the duct system, a pressure measurement sensor for measuring a pressure at the inlet of the duct system or within the connector and for transmitting a signal indicative of the sensed pressure, and a blower controller responsive to the signal for controlling a speed of the blower to control the pressure at said one of the plurality of exhaust pipes; and wherein a first one of said plurality of exhaust pipes receives exhaust gas from an engine of the vessel, and a second one of said plurality of exhaust pipes receives exhaust gas from a boiler of said vessel, and wherein:

a first one of said circuits is configured to receive exhaust gas from said first exhaust pipe, and a second one of said circuits is configured to receive exhaust gas from said second exhaust pipe; and wherein the controller of each circuit is configured to independently control the blower speed to control the measured pressure.

7. The system of claim 1, wherein each exhaust treatment circuit further comprises:

a connector positioning mechanism carried by the positioning system and configured to manipulate the corresponding connector over an exhaust pipe of the vessel to capture exhaust gases emitted from the exhaust pipe.

8. The system of claim 1, further comprising a deployment platform for supporting at least one of (i) the plurality of treatment systems and (2) the positioning system.

9. The system of claim 8, the deployment platform is selected from the group consisting of a concrete slab, a deck, a wharf, bare land, a truck, a chassis, a trailer, a jetty, a quay, a tension leg platform, a barge, a vessel, and a boat.

10. An exhaust treatment system for treating exhaust gases emitted from a plurality of exhaust pipes of an ocean-going vessel while at berth or at anchor, the system comprising:

a gas treatment system configured to reduce emissions in exhaust gas;

a exhaust capture system for temporarily connecting to multiple exhaust pipes of an ocean-going vessel at berth or anchor, the system comprising:

a boom system having a plurality of articulatable boom sections, each of the plurality of boom segment connected to an adjacent boom section by a respective hinge, the boom segment configured for a folded configuration for storage or transport and in one or more deployed configurations in which the boom segments are unfolded about the respective hinges, the boom segments including a terminal boom segment and a base boom segment;

a plurality of duct systems, each duct system comprising a set of rigid duct sections, each rigid duct section connected to an adjacent rigid duct section by a flexible duct section;

wherein each boom segment has mounted thereto a corresponding rigid duct section of each of the plurality of duct systems, and wherein corresponding ones of the flexible duct sections are arranged at corresponding hinges;

each of the plurality of duct systems further comprising a connector supported at the terminal boom segment and coupled to a corresponding rigid duct section, each connector configured to be fitted over an exhaust pipe of the vessel;

each duct system configured for connection to the gas treatment system by a respective connecting duct.

11. The system of claim 10, wherein the gas treatment system includes a plurality of gas treatment modules, each connected to a corresponding duct system by a corresponding connecting duct.

12. The system of claim 10, wherein each boom segment includes a rigid elongated structure, and wherein each corresponding rigid duct section of each of the plurality of duct systems is attached to the rigid elongated structure.

13. The system of claim 12, wherein for each boom segment, the plurality of duct systems includes first set and second set of at least one duct system, and wherein the first set and second set of corresponding duct sections are mounted on opposite sides of each elongated boom structure.

14. The system of claim 10, further comprising:

a connector positioning mechanism for each duct system and carried by the terminal boom segment, each connector positioning mechanism configured to orient the corresponding connector over an exhaust pipe of the vessel to capture exhaust gases emitted from the exhaust pipe with the boom system in a deployed position.

15. The system of claim 11, wherein:

each gas treatment module includes a blower;

each duct system includes a pressure measurement sensor for measuring a pressure at the inlet of the duct system or within the connector and for transmitting a signal indicative of the sensed pressure; a blower controller for each gas treatment module responsive to the signal for controlling a speed of the blower to control the pressure at said one of the plurality of exhaust pipes.

16. The system of claim 15, wherein a first one of said plurality of exhaust pipes receives exhaust gas from an engine of the vessel, and a second one of said plurality of exhaust pipes receives exhaust gas from a boiler of said vessel, and wherein:

a first one of said duct systems is configured to receive exhaust gas from said first exhaust pipe, and a second one of said duct systems is configured to receive exhaust gas from said second exhaust pipe; and wherein the respective blower controller is configured to independently control the blower speed to control the pressure.

17. A multi-circuit system for temporarily connecting to a single exhaust pipe of an oceangoing vessel at berth or at anchor and treating captured exhaust gas, the system comprising:

a processing system for receiving exhaust gas at an inlet port;

a duct system having a longitudinal extent sufficient to reach from the processing system to the single exhaust pipe on the oceangoing vessel; an inlet port of the duct system configured for attachment to a connector receiving exhaust gas from the single exhaust pipe, the connector configured for capturing exhaust gas in an engaged position relative to the exhaust pipe;

an outlet duct port of the duct system configured for connection to the inlet port of the processing system;

a blower connected fluidically to the duct system;

a pressure measurement sensor for measuring a gas pressure at the inlet of the duct system or within the connector and for transmitting a signal indicative of the sensed pressure;

a blower controller responsive to the signal for controlling a speed of the blower to control the gas pressure in an operational mode;

a positioning system for supporting the duct system and connector, the positioning system configured to position said duct system and connector in a temporary operational position in which the connector is engaged to capture exhaust gas from the exhaust pipe and the duct system conveys the captured exhaust gas to the processing system for treatment, and to position said duct system and connector in a non-operational position in which the duct system and connector in which the connectors are disengaged from the exhaust pipe and the duct system and connector are moved away from the vessel.

* * * * *